US005213938A

United States Patent [19]

Sacripante et al.

[11] Patent Number: 5,213,938

[45] Date of Patent: May 25, 1993

[54] OXIDATION OF TONER COMPOSITIONS

[75] Inventors: Guerino G. Sacripante; Raj D. Patel, both of Oakville; Grazyna E. Kmiecik-Lawrynowicz, Burlington; Lurdes M. Martins, Mississauga, all of Canada

[73] Assignee: Xerox Corporation, Stamford, Conn.

[21] Appl. No.: 868,810

[22] Filed: Apr. 15, 1992

[51] Int. Cl.[5] ..... G03G 9/08; G03G 9/093

[52] U.S. Cl. ..... 430/137; 430/109; 430/138

[58] Field of Search ..... 430/137, 138

[56] References Cited

U.S. PATENT DOCUMENTS

| | | | |
|---|---|---|---|
| 4,465,756 | 8/1984 | Mikami et al. | 430/138 |
| 4,626,490 | 12/1986 | Yamazaki et al. | 430/138 |
| 4,727,011 | 2/1988 | Mahabadi et al. | 430/138 |
| 4,789,617 | 12/1988 | Arahara et al. | 430/137 |
| 4,797,339 | 1/1989 | Maruyama et al. | 430/109 |
| 4,816,366 | 3/1989 | Hyosu et al. | 430/137 |
| 4,937,167 | 6/1990 | Moffat et al. | 430/137 |
| 4,996,127 | 2/1991 | Hasegawa et al. | 430/109 |
| 5,009,978 | 4/1991 | Yoshida et al. | 430/137 X |

FOREIGN PATENT DOCUMENTS

| | | | |
|---|---|---|---|
| 65855 | 4/1984 | Japan | 430/137 |

*Primary Examiner*—Roland Martin
*Attorney, Agent, or Firm*—E. O. Palazzo

[57] ABSTRACT

A process for the preparation of toner compositions which comprises the oxidation and metal chelation of the surface thereof; and a process for the preparation of toners which comprises the oxidation and metal chelation of the surface thereof, and subsequently coalescence by the absorption or sticking thereto of a fluoro containing polymer.

21 Claims, No Drawings

OXIDATION OF TONER COMPOSITIONS

BACKGROUND OF THE INVENTION

The present invention is generally directed to toner compositions and processes thereof, and more specifically to the surface modification of toners, including in situ toners, and overcoated toner compositions directly generated from toner compositions without resorting to the conventional pulverization and classification methods. In one embodiment, the present invention relates to the surface modification of toners by an aqueous oxidation and metal chelation thereof, thereby providing excellent flow characteristics without the use of known flow additives, like colloidal silicas, and wherein the toner flowability is excellent, such as from about 1 percent to about 20 percent cohesion as measured by the HOSOKAWA FLOW TESTER TM. In another embodiment, the present invention relates to the surface modification of toners by an aqueous oxidation and metal chelation thereof, followed by the coalescence, that is absorption of fluorinated resins by emulsion polymerization to control the triboelectrical properties thereof, and to enable toners without the use of known flow additives, like colloidal silicas, with excellent flow characteristics, of from about 1 percent to about 20 percent cohesion as measured by the HOSOKAWA FLOW TESTER TM, and wherein the toner compositions treated in embodiments are comprised of a core comprised of a polymer resin and colorants, including color pigments, dyes, or mixtures thereof, and an outer coating layer comprised of a cellulose component, such as methyl cellulose, hydroxypropyl cellulose, hydroxyethylmethyl cellulose, and the like, and wherein the cellulose layer functions primarily as a protective coating for the core components, especially during the preparation thereof, and thereafter the cellulose is oxidized and metal chelated with a metallic oxidizing reagent such as cerium ammonium nitrate, chromium oxide, chromic acid, potassium permanganate and the like. The processes of the present invention in embodiments thereof are comprised of an initial dispersion step for forming a stabilized organic microdroplet suspension in an aqueous medium containing a cellulose surfactant, a hydroxyalkyl cellulose, wherein alkyl contains from 1 to about 12 carbon atoms, such as hydroxyethylmethyl cellulose, methyl cellulose or the like; followed by the free radical polymerization of the core monomers; and subsequently oxidizing and metal chelating the surface thereof with an organometallic or metallic containing reagent such as cerium ammonium nitrate, or chromium oxide and the like, and optionally thereafter coalescing or an absorbing fluorinated polymer or polymers by emulsion polymerization to control the triboelectrical properties thereof, and to enable toners with excellent flow characteristics without the use of known flow additives of from about 1 percent to about 20 percent cohesion as measured by the HOSOKAWA FLOW TESTER TM.

In reprography, such as xerographic or ionographic technologies wherein single and two component development can be utilized, black or colored dry toners are employed. It is often very desirable that the aforementioned toners particles with excellent toner characteristics are utilized, such as excellent powder flow of from about one percent cohesion to about 20 percent cohesion, and preferably from about 3 percent cohesion to about 10 percent cohesion as measured by the HOSOKAWA POWDER TESTER TM. Excellent powder flow is usually necessary for the effective development and transfer of a toner image. Toner particles of from about 5 microns in diameter (average volume) size to about 20 microns in diameter can be selected, and transfer of toner from a packaged container into a machine developer housing is effected smoothly and efficiently without, or with minimal clogging or remaining aggregated toner in the packaged container. Additionally, the mixing of toner with carriers in a developer housing should also proceed in a timely and sufficiently homogeneous manner such that toner clumps are not isolated from the carrier component. Accordingly, toners with poor flowability can cause uneven toner image mass, adversely affecting triboelectric charge characteristics and hence cause poor image development, and poor image resolution. To overcome some of these problems, it is customary to blend onto the toner surfaces external additives such as colloidal silicas, tin oxide or metal stearates, such as zinc stearate and the like. These aforementioned external additives can be submicron in sizes ranging from about 5 nanometers to about 100 nanometers for colloidal silicas and tin oxide, and from about 0.1 micron to about 4 microns for the metal stearates. Furthermore, the external additives are usually dry blended onto the toner surfaces employing high shearing devices such as a Lightnin blender, and it is important that overblending or overshearing is avoided so that the toner particles are not fractured or damaged during the processing thereof. However, the use of submicron external additives onto the toner surface may have an impact on health issues, due to the ease at which these submicron particles are airborne, especially during the transfer of fresh toner into a developer housing. Furthermore, the use of external additives onto toner surfaces can cause mechanical failures or deterioration of machine performance due to the accumulation of submicron particles into other machine parts, especially after extensive use. The toners and processes of the present invention in embodiments eliminate or overcome these difficulties through the chemical modification of the toner surfaces by oxidizing and metal chelating the toner surfaces, thereby providing excellent powder flow, without the use of external blended additives, such as colloidal silicas and the like, of from about 1 percent to about 20 percent cohesion as measured by the the HOSOKAWA POWDER TESTER TM. The surface modifying reagents are oxidizers and metal containing reagents such as cerium ammonium nitrate and the like. The use of a non-metallic oxidizing reagent such as sodium periodate, can oxidize the toner surface and modify the triboelectric charge thereof, and it is found that poor powder flow characteristics, such as from about 25 percent to about 70 percent cohesion are obtained with such reagents as measured by the HOSOKAWA POWDER TESTER TM. Therefore, it is important that the reagent contain a metal species capable of chelating or complexing in addition to oxidizing.

Additionally, in color reprography, such as in full color or highlight color applications, colored toners with a wide variety of colors including black are usually employed. For two component development, it is highly desirable that the triboelectric properties of different colored toners be desirably controlled so that they all attain similar equilibrium triboelectric charging levels when utilized against a selected carrier. This is especially useful for custom colored toner packages, since colored toners with a wide variety of custom colors can be obtained by simple blending of the primary colored toners. Another important aspect for two component development is the rate of charging of the fresh toners to the equilibrium charge levels when they are added to the toner depleted development housing. A fast rate of charging of fresh toner can be important in ensuring proper image development, particularly for high speed reprographic systems. These and other advantages are enabled with the compositions and processes of the present invention in embodiments. It is known that color pigments or dyes present in the toner have a dominant effect on the toner's triboelectric charging behavior, arising primarily because these colorants are often also present at or close to the surface of the toner, and are, therefore, exposed to their environments. As a consequence, when the toner particles are admixed with carriers, the interactions of the exposed pigments of the toners with the carrier particles may drastically affect the charging behavior of the toner. Similar effects are obtained for a number of prior art encapsulated toners where the color pigment particles are not completely encapsulated within the toner shell. Thus, it is often observed that toners with identical components, except colorants, exhibit different charging behavior, even to the extent of having triboelectric charges of opposite polarity. To overcome this difficulty, it is usually necessary to utilize different charge control additives for different colorants, or to use high levels of charge control additives so as to nullify or overcome the different charging effects of different colorants, and thus minimize the dominating influence of the colorant on the charging characteristics of the toners. The toners and processes of the present invention in embodiments eliminate or minimize this difficulty through the coalescence or absorption of fluorinated resins by emulsion polymerization onto the toner surface modified by oxidation and metal chelation by a metallic reagents such as cerium ammonium nitrate and the like. As a consequence, the need to rely on different or high levels of charge control additives for different colored toners for achieving similar triboelectric charging levels is eliminated or substantially minimized, and wherein excellent flow characteristics results such as excellent powder flow of from about (throughout includes the ranges in between) 1 percent to about 20 percent cohesion as measured by the HOSOKAWA POWDER TESTER TM. Other advantages associated with the toner compositions obtained by the processes of the present invention include, for example, rapid triboelectric charging rates, small toner size and narrow size distribution for high resolution images, excellent color mixing properties and image color fidelity, high image projection efficiency enabling their use on transparent substrates, lower fusing temperatures, and toner nonblocking and nonagglomerating characteristics.

Furthermore, the surface modified toner compositions of the present invention can be selected for a variety of known imaging and printing processes including electrophotographic and ionographic processes.

Encapsulated toners and processes are known. For example, U.S. Pat. No. 4,626,490 discloses an encapsulated toner comprised of a core material comprised of a long chain organic compound and a higher carboxylic acid encapsulated with a thin shell material; see Example 1, column 10, line 12, wherein an external additive comprised of fine powdery $SiO_2$ was used for image formation, and also Examples 2 through 9 employing similar external additives. The toners of the present invention, through the oxidation and metal chelation of the surface thereof, does not require external additives and are utilized as such in image formation. There is also disclosed in U.S. Pat. No. 4,797,339 an in situ toner comprising an inner layer comprised of a resin ion complex having a coloring agent and an outer layer containing a flowability imparting agent; see column 5, lines 3 to 13, wherein the flowability imparting agents in addition to the perfluoroalcohol acrylate agent, includes benzoquanamine formaldehyde resin and hydrophobic silica. Similarly, U.S. Pat. Nos. 4,789,617; 4,601,968; 4,592,990; 4,904,562; 4,465,756; 4,468,446; 4,533,616; 4,565,763 and 4,592,990 also disclose the use of external surface additives to toner surfaces prior to image formation.

Encapsulated toners displaying triboelectric charge passivation are also known. For example, U.S. Pat. No. 4,937,167, the disclosure of which is totally incorporated herein by reference, discloses an encapsulated toner comprised of a core resin, colorant and polyurea shell wherein triboelectric nullification or passivation is achieved. However, note column 17, lines 2 to 14, wherein external additives, such as AEROSILS®, aluminas or silicas, are added onto the toner surface prior to image formation, and note Example 1, column 21 on line 16, wherein additives including charge control agents are blended onto the toner prior to image formation. The encapsulated toners of the present invention, through the oxidation and metal chelation of the surface followed by coalescence of fluorinated resins thereof, results in triboelectric charge control or passivation without the use of external additives, and can be utilized as such in imaging and printing apparatuses. Other prior art relating to encapsulated toners and processes thereof include U.S. Pat. Nos. 4,803,142; 4,656,111; 4,517,273; 4,543,312; 4,609,607; 4,784,930; 4,307,169; 4,617,249 and 4,702,989.

Additionally (D/90516), now U.S. Pat. No. 5,175,071, the disclosure of which is fully incorporated herein by reference, discloses an in situ toner comprised of a core resin, colorant and cellulose shell coating, and wherein passivation results, however, surface additives are also added onto the surface by blending prior to image formation.

There is a need for black or colored toners wherein excellent flow characteristics are obtained without the use of external additives. Furthermore, there is a need for colored toners wherein the triboelectric charge is not influenced by the colored pigment employed, also known as passivation, wherein the use of external additives is avoided or minimized and result in excellent toner flow characteristics. In addition to the above, there is also a need for black and colored toners that are nonblocking, of excellent image resolution, and nonsmearing.

SUMMARY OF THE INVENTION

It is an object of the present invention to provide toner compositions and processes thereof with many of the advantages illustrated herein.

It is also an object of the present invention to provide an oxidation, metal chelation and coalescence or absorption processes for toner compositions thereby enabling, for example, toners with desirable properties such as excellent toner powder flow, of from about 1 percent to about 20 percent cohesion, nonblocking characteristics, excellent color fidelity, excellent image transparency projection efficiency, resistance to vinyl offset, excellent image permanence characteristics, and passivation.

In another object of the present invention there are provided processes for the oxidation and metal chelation of toner compositions comprised of a core of polymer resin, colorants such as pigments, dyes, or mixtures thereof, and thereover a coating comprised of TYLOSE®, a hydroxyethylmethyl cellulose, a methyl cellulose, or the derivatives thereof.

Another object of the present invention is the provision of processes for toner compositions with triboelectric properties are predominantly controlled by the coalescence or absorption of fluorinated resins onto the toner surface by emulsion polymerization.

In another object of the present invention there are provided processes for the oxidation and metal chelation of toner compositions followed by the emulsion coalescence and free radical polymerization of fluorinated polymers onto the toner surface, which toner is comprised of a core of polymer resin, colorants such as pigments, dyes, or mixtures thereof, and thereover a coating comprised of TYLOSE®, a hydroxyethylmethyl cellulose, a methyl cellulose, or the derivatives thereof.

Another object of the present invention is the provision of processes for toner compositions with triboelectric properties predominantly controlled by the emulsion coalescence and free radical polymerization of fluorinated polymers onto the toner surface.

Further, in another object of the present invention, there are provided processes for the coalescence and free radical polymerization of fluorinated polymers onto the toner surface of colored toners which exhibit similar equilibrium triboelectric properties against a selected carrier irrespective of the colorants present.

A related object of the present invention is the provision of processes for colored toner compositions with a triboelectric charging polarity that can be desirably controlled or adjusted by the ratio of fluorinated and nonfluorinated free radical monomers during the emulsion polymerization and coalescence process.

A still further object of the present invention is to provide processes for the modification of colored toners which possess rapid rates of triboelectric charging when admixed with carrier particles.

A further object of the present invention is to provide a simple process for the generation of small sized black and colored toners with narrow size distribution without the need to resort to conventional pulverization and classification techniques.

A still further object of the present invention is to provide a simple process for the generation of small sized black and colored toners with narrow size distribution without the need for the addition of external surface additives, such as colloidal silicas, tin oxide or metal stearates and the like.

Another object of the present invention is directed to providing processes for the removal of surfactants from toners, like encapsulated toners, and in situ toners by the oxidation and metal chelation of the surface thereof with known metallic oxidizing agents, such as cerium ammonium nitrate, chromium oxide, potassium permanganate and the like.

In yet a further object, the present invention is directed to providing processes for obtaining excellent powder flow characteristics without resorting to dry blending process.

In a further object of the present invention there are provided preparative processes for directly generating toner compositions comprised of a polymer resin or resins and colorants overcoated with a layer of a polymer, such as a cellulose polymer, followed by the surface oxidation and metal chelation thereof and the coalescence and emulsion free radical polymerization of fluorinated monomers thereto, and wherein the triboelectric charging effects of the colorants are passivated or substantially passivated, and excellent powder flow characteristics are obtained.

In one embodiment of the present invention, there are provided processes for the preparation of toners by the oxidation and metal chelation of the surfaces thereof. More specifically, there can be oxidized and metal chelated with the process of the present invention encapsulated toners and toners free of encapsulation.

Embodiments of the present invention include a process for the preparation of toner compositions which comprises the oxidation and metal chelation of the surface thereof; and a process for the preparation of toners which comprises the oxidation and metal chelation of the surface thereof, and subsequently coalescence by the absorption or sticking thereto of a fluoro containing polymer.

The toner compositions to be oxidized and metal chelated can be prepared by a simple one-pot process involving formation of stabilized particle suspension, followed by a core resin forming free radical polymerization within the particles. The process is comprised of, for example, (1) thoroughly mixing or blending a mixture of core resin monomers, optional preformed core resins, free radical initiators, and colorants; (2) dispersing the aforementioned well blended mixture by high shear blending to form stabilized microdroplets of specific droplet size, such as from about 3 microns in diameter to about 11 microns in diameter, in an aqueous medium containing a suitable cellulose polymer, such as TYLOSE® and an optional inorganic surfactant, and wherein the volume average microdroplet diameter can be desirably adjusted to be from about 2 microns to about 30 microns with the volume average droplet size dispersity being less than 1.35 as inferred from a Coulter Counter; (3) effecting free radical polymerization to form the core resin by heating; (4) simultaneously oxidizing and metal chelating the resulting polymerized toner with a metallic oxidizing reagent such as cerium ammonium, chromic acid or potassium permanganate of from about 0.5 to about 10 percent by toner weight; and (5) thereafter separating the resulting particles by washing and drying by known methods. The formation of the stabilized particle suspension is generally conducted at ambient, about 25° C. in embodiments, temperature, while the free radical polymerization is carried out at a temperature of from about 35° C. to about 120° C., and preferably from about 45° C. to about 90° C., for a period of from about 1 to about 24 hours depending primarily on the monomers and free radical initiators used. The toner comprised of a core resin obtained via free radical polymerization, together with the optional preformed polymer resin, comprises from about 75 to about 99 percent, and preferably from about 85 to about 95 percent by weight of the toner, the colorant, or pigment comprises from about 1 to about 15 percent by weight of the toner, the cellulose coating comprises from about 0.001 to about 5 percent by weight of the toner, and the metallic chelating agent comprises from about 0.1 to about 2 percent of the toner in embodiments.

Additionally, the oxidized and metal chelated toner composition to be coalesced and fluorinated can be prepared by a simple one-pot process involving formation of a stabilized particle suspension, followed by a core resin forming free radical polymerization within the particles. The process is comprised of, for example, (1) thoroughly mixing or blending a mixture of core resin monomers, optional preformed core resins, free radical initiators, and colorants; (2) dispersing the aforementioned well blended mixture by high shear blending to form stabilized microdroplets of specific droplet size and size distribution in an aqueous medium containing a suitable cellulose polymer, such as TYLOSE® and an optional inorganic surfactant, and wherein the volume average microdroplet diameter can be desirably adjusted to be from about 2 microns to about 30 microns with the volume average droplet size dispersity being less than 1.35 as inferred from a Coulter Counter; (3) effecting the free radical polymerization to form a core resin by heating; (4) oxidizing and metal chelating the polymerized toner with a metallic reagent such as cerium ammonium nitrate or chromium oxide; (5) washing with water and adding a mixture of fluorinated and nonfluorinated free radical monomers, such as trifluoroethylmethacrylate and methylmethacrylate, respectively, and inorganic initiator, such as potassium persulfate and sodium bisulfite; and (6) separating the resulting toner particles by washing and drying by known methods such spray drying or fluidized bed drying. The formation of stabilized particle suspension is generally conducted at ambient temperature, about 25° C. in embodiments, while the free radical polymerization is carried out at a temperature from about 35° C. to about 120° C., and preferably from about 45° C. to about 90° C., for a period of from about 1 to about 24 hours depending primarily on the monomers and free radical initiators used. The toner comprised of a core resin obtained via free radical polymerization, together with the optional preformed polymer resin, comprises from about 75 to about 97 percent, and preferably from about 85 to about 95 percent by weight of toner, the colorant comprises from about 1 to about 15 percent by weight of the toner, the cellulose coating comprises from about 0.001 to about 2 percent by weight of the toner, the organometallic chelating agent comprises from about 0.1 to about 2 percent of the toner, and the coalesced fluorinated polymer comprises from about 1 percent to about 5 percent by weight of the toner in embodiments thereof.

Illustrative examples of free radical monomers, which are subsequently polymerized, include a number of known components such as acrylates, methacrylates, olefins including styrene and its derivatives such as methyl styrene, and the like. Specific examples of core monomers include methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, acrylic acid, methacrylic acid, vinyl chloride, vinylidene chloride, styrene, substituted styrenes, other substantially equivalent addition monomers, and known addition monomers, reference for example U.S. Pat. No. 4,298,672, the disclosure of which is totally incorporated herein by reference, and mixtures thereof. Illustrative examples of optional preformed core resins include styrene polymers, such as styrene-butadiene copolymers, PLIOLITES®, PLIOTONES®, polyesters, acrylate and methacrylate polymers, and the like.

Various known colorants may be selected for the toner compositions providing, for example, that they do not substantially interfere with the free radical polymerization. Typical examples of specific colorants, preferably present in an effective amount of, for example, from about 3 to about 10 weight percent of toner include PALIOGEN VIOLET 5100 TM and 5890 TM (BASF), NORMANDY MAGENTA RD-2400 TM (Paul Uhlich), PERMANENT VIOLET VT2645 TM (Paul Uhlich), HELIOGEN GREEN L8730 TM (BASF), ARGYLE GREEN XP-111-S TM (Paul Uhlich), BRILLIANT GREEN TONER GR 0991 TM (Paul Uhlich), LITHOL SCARLET D3700 TM (BASF), TOLUIDINE RED TM (Aldrich), SCARLET TM for Thermoplast NSD Red (Aldrich), LITHOL RUBINE TONER TM (Paul Uhlich), LITHOL SCARLET 4440 TM, NBD 3700 (BASF), BON RED C TM (Dominion Color), ROYAL BRILLIANT RED RD-8192 TM (Paul (Uhlich), ORACET PINK RF TM (Ciba Geigy), PALIOGEN RED 3340 TM and 3871K TM (BASF), LITHOL FAST SCARLET L4300 TM (BASF), HELIOGEN BLUE D6840 TM, D7080 TM, K7090 TM, K6902 TM, K6910 TM and L7020 TM (BASF), SUDAN BLUE OS TM (BASF), NEOPEN BLUE FF4012 TM (BASF), PV FAST BLUE B2G01 TM (American Hoechst), IRGALITE BLUE BCA TM (Ciba Geigy), PALIOGEN BLUE 6470 TM (BASF), SUDAN II TM, III TM and IV TM (Matheson, Coleman, Bell), SUDAN ORANGE TM (Aldrich), SUDAN ORANGE 220 TM (BASF), PALIOGEN ORANGE 3040 TM (BASF), ORTHO ORANGE OR 2673 TM (Paul Uhlich), PALIOGEN YELLOW 152 TM and 1560 TM (BASF), LITHOL FAST YELLOW 0991K TM (BASF), PALIOTOL YELLOW 1840 TM (BASF), NOVAPERM YELLOW FGL (Hoechst), PERMANENT YELLOW YE 0305 (Paul Uhlich), LUMOGEN YELLOW D0790 TM (BASF), SUCO-GELB L1250 TM (BASF), SUCO-YELLOW D1355 TM (BASF), SICO FAST YELLOW D1165 TM, D1355 TM and D1351 TM (BASF), HOSTAPERM PINK E TM (Hoechst), FANAL PINK D4830 TM (BASF), CINQUASIA MAGENTA TM (DuPont), PALIOGEN BLACK L0084 TM (BASF), PIGMENT BLACK K801 TM (BASF) and carbon blacks such as REGAL 330® (Cabot), CARBON BLACK 5250 TM and 5750 TM (Columbian Chemicals), and the like.

Examples of surfactants selected for the toners and processes of the present invention include, alkyl celluloses, with the alkyl groups containing, for example, from 1 to about 12 carbon atoms; and more specifically methyl cellulose, ethyl cellulose, hydroxyethyl cellulose, hydroxypropyl cellulose, hydroxyethylmethyl cellulose, TYLOSE® and the like. The effective concentration of the cellulose polymer in the aqueous phase at the dispersion or microdroplet formation step is, for example, from about 0.1 percent by weight to about 5 percent by weight, with the preferred amount being determined primarily by the nature of the toner precursor materials and the desired toner particle size. In embodiments, inorganic surfactants are also utilized in combination with the cellulose polymer for achieving a smaller microdroplet size. Illustrative examples of suitable inorganic surfactants include alkali salts, such potassium oleate, potassium caprate, potassium stearate, sodium laurate, sodium dodecyl sulfate, sodium oleate, sodium laurate, and the like. The effective concentration of inorganic surfactant that is generally employed is for exmaple from about 0.005 to about 0.5 percent by weight, and preferably from about 0.01 to about 0.10 percent by weight.

Illustrative examples of known free radical initiators that can be selected for the preparation of the toners include azo-type initiators, such as 2-2'-azobis(dimethylvaleronitrile), azobis(isobutyronitrile), azobis(cyclohexane-nitrile), azobis(methyl-butyronitrile), mixtures thereof, and the like, peroxide initiators such as benzoyl peroxide, lauroyl peroxide, methyl ethyl ketone peroxide, isopropyl peroxy-carbonate, 2,5-dimethyl-2,5-bis(2-ethylhexanoyl-peroxy)hexane, di-tert-butyl peroxide, cumene hydroperoxide, dichlorobenzoyl peroxide, potassium persulfate, ammonium persulfate, sodium bisulfite, a combination of potassium persulfate and sodium bisulfite, and mixtures thereof, with the effective quantity of initiator being, for example, from about 0.1 percent to about 10 percent by weight of that of core monomer.

Examples of oxidizing and chelating metallic reagents or components include cerium ammonium nitrate, chromium oxides, alkali metals, such as potassium permanganate, chromium perchlorate, chromium nitrate, sodium dichromate, ammonium dichromate, potassium dichromate, metal nitrates like aluminum nitrate, boronic acid, barium perchlorate, calcium perchlorate, cobalt perchlorate, copper perchlorate, copper nitrate, dysprosium nitrate, iron nitrate, iron perchlorate, indium perchlorate, indium nitrate, ammonium hexachloroiridium, potassium hexanitroiridium, sodium hexanitroiridium, potassium pentabromonitroiridium, potassium chromate, sodium chromate, potassium hydroxytetranitronitrosylruthenium, manganese nitrate, sodium metaborate, hydrogen metaborate, sodium tetraborate, sodium hexanitroiridium, sodium hexanitroiron, nickel perchlorate, lead chromate, lead nitrate, mixtures thereof and the like, with the effective amount of the aforementioned component being, for example, from about 0.1 percent to about 10 percent by weight of that of the core monomer. In addition to the above, an acid or base may be added for the aqueous dissolution of chelating metallic reagent, such as nitric acid, hydrochloric acid, hydrobromic acid, hydroiodic acid, phosphoric acid, sulfuric acid, mixtures thereof and the like.

Examples of fluorinated monomers utilized in the emulsion coalescence of polymers onto the toner surface include a number of known materials like fluoroalkylacrylates, fluoromethacrylates or fluorostyrenes such as trifluoromethylmethacrylate, trifluoroethylmethacrylate, trifluoropropylmethacrylate, trifluoromethylacrylate, trifluoroethylacrylate, fluoromethylmethacrylate, fluoroethylmethacrylate, fluoropropylmethacrylate, fluoromethylacrylate, fluoroethylacrylate, methylacrylate, difluoromethylmethacrylate, difluoroethylmethacrylate, difluoropropylmethacrylate, difluoromethylacrylate, difluoroethylacrylate, fluorostyrene, difluorostyrene, trifluorostyrene, tetrafluorostyrene, pentafluorostyrene, mixtures thereof and the like, with the effective quantity of polymer being, for example, from about 1 percent to about 10 percent by weight of the toner. Alkyl includes from 1 to about 25 carbon atoms.

In embodiments, the coated surface modified toner composition can be prepared by (i) mixing a core resin forming monomer such as styrene from about 0.6 mole to 0.8 mole, n-butyl acrylate from about 0.06 mole to about 0.08 mole, a colorant such as HELIOGEN BLUE TM from about 0.01 mole to about 0.015 mole, a free radical initiator, such as VAZO 67 TM, from about 0.001 mole to about 0.003 mole; (ii) dispersing this mixture using a high shearing device such as a Brinkmann 45G probe at from about 8,000 to about 10,000 rpm for a duration of from about 30 to about 120 seconds, in a vessel containing from about a 0.5 liter to about 0.75 liter of water having dissolved therein a cellulose surfactant, such as TYLOSE ®, of from about 0.75 to about 1 percent by weight of the water, and an ionic surfactant such as sodium dodecylsulfate of from about 0 to 0.04 percent by weight of the water; (v) heating the mixture to effect free radical core polymer formation, from about 60° C. to about 95° C. and for a duration of from about 360 minutes to about 720 minutes; (vi) adding a metallic reagent such as cerium ammonium nitrate, from about 0.01 to about 0.2 mole with about 10 milliliters to about 20 milliliters of an aqueous solution of one percent nitric acid; (vii) washing by centrifugation from about one to about two times, and resuspending in water, from about 0.5 liter to about 0.75 liter, and adding thereto a mixture of trifluoroethyl methacrylate from about 0.05 mole to 0.2 mole, methyl methacrylate from about 0 mole to about 0.1 mole, an emulsion free radical initiator such as potassium persulfate and sodium bisulfite of from about 0.001 mole to about 0.003 mole each, and stirring with a mechanical stirrer at ambient temperature for a duration of 240 minutes to about 480 minutes, at which time the ensuing flourinated resin coalesces or absorbs onto the toner surface containing a TYLOSE ® coating. The toner product is then washed by centrifugation from about four to about six times, dried using preferably a fluidized bed, operated of from about 30° C. to about 60° C. for a duration of from about 240 minutes to about 480 minutes. The toner can comprise from about 90 percent to about 95 percent of core polymer or resin, the colorant comprises from about 2 percent to about 7 by weight of the toner, the cellulose coating comprises from about 0.01 to about 1 percent by weight of the toner, the organometallic chelating agent comprises from about 2 percent to about 45 percent of the toner, and the coalesced fluorinated polymer comprises from about 3 percent by weight of the toner.

The following Examples are being submitted to further define various species of the present invention. These Examples are intended to be illustrative only and are not intended to limit the scope of the present invention. Comparative Examples are also provided.

COMPARATIVE EXAMPLE I

A 5.6 micron (volume average particle diameter) cyan in situ toner comprised of a styrene acrylate core, HELIOGEN BLUE TM pigment, and hydroxyethylmethylcellulose coating, and oxidized with sodium periodate was prepared as follows.

A mixture of 176 grams of styrene, 24 grams of n-butyl acrylate, and 7 grams of HELIOGEN BLUE TM (obtained from Hoechst) pigment was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. One hundred and fifty (150) grams of the resulting mixture were transferred to a 2-liter reaction vessel containing 700 milliliters of a 1.0 percent aqueous TYLOSE ® solution containing 0.02 percent by volume of sodium dodecylsulfate, and the resulting mixture was homogenized for 2 minutes using a Brinkmann polytron operating at 10,000 rpm. Thereafter, the mixture was mechanically stirred at room temperature, 25° C., for 30 minutes. The resulting mixture was subsequently heated to 80° C. over a period of 1 hour, and retained at this temperature for another 10 hours before cooling it down to room temperature. The product was washed repeatedly with water until the aqueous phase was clear, and then freeze dried utilizing a fluid bed dryer operated at room temperature to about 40° C. The in situ toner, comprised of about 96 percent of the above core resin, about 3.5 percent of the above pigment, and about 0.01 to about 0.5 percent of the cellulose coating, evidenced a volume average particle diameter of 5.6 microns, and a particle size distribution of 1.33 according to Coulter Counter measurements.

The powder flow was evaluated by utilizing known methods, and specifically by the HOSOKAWA POWDER TESTER ® apparatus for measuring cohesion. The cohesion measurement uses three brass screens of known weight which are connected in series. The top screen has a 149 micrometer mesh size, the middle screen has a 74 micrometer mesh size, and the bottom screen has a 45 micrometer mesh size. A toner sample (2 grams) is placed on the top screen and the vibration thereof was accomplished for 95 seconds. The mass of the toner remaining on each of the screens is then used to calculate the percent cohesion. High cohesion values, such as from about 25 percent cohesion to about 100 percent cohesion are considered poor, whereas low cohesion values such as less than 20 percent are considered acceptable and preferably less than 10 percent are considered excellent. For the toner of this Example, the powder flow was evaluated to be 66 percent cohesion, and is considered as a poor flowability toner.

A charged developer was prepared by blending 98 parts by weight of the above coated toner particles obtained with 2 parts by weight of Xerox Corporation 9200 carrier particles comprised of a ferrite core coated with a terpolymer of methylmethacrylate, styrene, and vinyl triethoxy polymer, 0.7 percent weight coating, reference U.S. Pat. Nos. 3,467,634 and 3,526,533, the disclosures of which are totally incorporated herein by reference. The toner displayed a triboelectric value of 35 microcoulombs per gram as determined in the known Faraday Cage apparatus. Also, latent images were formed in a xerographic experimental imaging device similar to the Xerox Corporation 9200, and poor images were obtained with the aforementioned developer, such as low contrast and unacceptable resolution characteristics with undesirable background deposits.

COMPARATIVE EXAMPLE II

A 5.6 micron (volume average particle diameter) cyan in situ toner comprised of a styrene acrylate core, HELIOGEN BLUE TM pigment, methyl ethylcellulose coating, and oxidized with sodium periodate was prepared as follows.

A mixture of 176 grams of styrene, 24 grams of n-butyl acrylate, and 7 grams of HELIOGEN BLUE TM (available from BASF) pigment was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. One hundred and fifty (150) grams of the resulting mixture were transferred to a 2-liter reaction vessel containing 700 milliliters of a 1.0 percent aqueous TYLOSE ® solution containing 0.02 percent by volume of sodium dodecylsulfate, and the resulting mixture was homogenized for 2 minutes using a Brinkmann polytron operating at 10,000 rpm. Thereafter, the mixture was mechanically stirred at room temperature for 30 minutes. The resulting mixture was subsequently heated to 80° C. over a period of 1 hour, and retained at this temperature for another 10 hours before cooling it down to room temperature. To this was then added 10 grams of sodium periodate, and the resulted mixture stirred overnight, about 18 hours, at 25° C. The product was washed repeatedly with water by centrifugation until the aqueous phase was clear, and then freeze dried utilizing a fluid bed dryer operated at ambient temperature to about 40° C. The in situ toner product, comprised of about 96 percent of the above core resin, about 3.5 percent of the above pigment, and about 0.01 to about 0.5 percent cellulose coating, evidenced a volume average particle diameter of 5.6 microns, and a particle size distribution of 1.33 according to Coulter Counter measurements. For the toner of this Example, the powder flow was evaluated to 65 percent cohesion as measured by the HOSOKAWA POWDER TESTER TM as described in Comparative Example I.

A charged developer was then prepared as described in comparative Example I. The toner of this Example displayed a triboelectric value of 25 microcoulombs per gram as determined in the known Faraday Cage apparatus. Also, latent images were formed in a xerographic experimental imaging device similar to the Xerox Corporation 9200, and poor images were obtained with the aforementioned developer, such as low contrast and unacceptable resolution characteristics.

EXAMPLE I

A 5.6 micron (volume average particle diameter) cyan in situ toner comprised of a styrene acrylate core, HELIOGEN BLUE TM pigment, methylethyl cellulose coating, and oxidized and metal chelated with cerium ammonium nitrate was prepared as follows.

A mixture of 176 grams of styrene, 24 grams of n-butyl acrylate, and 7 grams of HELIOGEN BLUE TM pigment (obtained from BASF) was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. One hundred and fifty (150) grams of the resulting mixture were transferred to a 2-liter reaction vessel containing 700 milliliters of a 1.0 percent aqueous TYLOSE ® solution containing 0.02 percent by volume of sodium dodecylsulfate, and the resulting mixture was homogenized for 2 minutes using a Brinkmann polytron operating at 10,000 rpm. Thereafter, the mixture was mechanically stirred at room temperature for 30 minutes. The resulting mixture was subsequently heated to 80° C. over a period of 1 hour, and retained at this temperature for another 10 hours before cooling it down to room temperature. To this was then added 7.5 grams of cerium ammonium nitrate and 75 grams of a one percent aqueous solution of nitric acid, and the resulting mixture stirred overnight at 25° C. The product was washed repeatedly with water by centrifugation until the aqueous phase was clear, and then freeze dried utilizing a fluid bed dryer operated at ambient temperature to about 40° C. The in situ toner product obtained, comprised about 94 percent of the above of styrene n-butyl acrylate core resin, about 3.0 percent of the above blue pigment, about 0.01 to about 0.5 percent of the above cellulose coating, and about 2 percent of chelated cerium, evidenced a volume average particle diameter of 5.6 microns, and a particle size distribution of 1.33 according to Coulter Counter measurements. For the toner of this Example, the powder flow was evaluated to 7 percent cohesion as measured by the HOSOKAWA POWDER TESTER ® as described in Comparative Example I. The powder flow characteristics of this toner are thus considered to be excellent.

A charged developer was then prepared as described in Comparative Example I. The toner of this Example displayed a triboelectric value of 7.5 microcoulombs per gram as determined in the known Faraday Cage apparatus. Also, latent images were formed in a xerographic experimental imaging device similar to the Xerox Corporation 9200, and excellent images were obtained with the aforementioned developer, such as excellent resolution characteristics.

The use of the strong metallic oxidizer of cerium ammonium nitrate resulted in surface oxidation and metal chelation of the toner surface changing the triboelectric charge to about 7.5 microcoulombs per gram as compared to 35 microcoulombs per gram (Comparative Example I), and in addition resulted in excellent powder flow characteristics of about 7 percent cohesion as compared to comparative Example I wherein the powder flow was about 65 percent cohesion. Also, the use of a metallic reagent such as cerium ammonium nitrate resulted in excellent powder flow characteristics of 7 percent cohesion as compared to Comparative Example II (65 percent) wherein a nonmetallic oxidizer such as sodium periodate was utilized.

EXAMPLE II

A 5.6 micron (volume average particle diameter) cyan in situ toner comprised of a styrene-acrylate core, HELIOGEN BLUE TM pigment, methylethyl cellulose coating, and oxidized and metal chelated with cerium ammonium nitrate was prepared as follows.

A mixture of 176 grams of styrene, 24 grams of n-butyl acrylate, and 7 grams of HELIOGEN BLUE TM pigment (obtained from BASF) was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. One hundred and fifty (150) grams of the resulting mixture were transferred to a 2 liter reaction vessel containing 700 milliliters of a 1.0 percent aqueous TYLOSE ® solution containing 0.02 percent by volume of sodium dodecylsulfate, and the resulting mixture was homogenized for 2 minutes using a Brinkmann polytron operating at 10,000 rpm. Thereafter, the mixture was mechanically stirred at room temperature for 30 minutes. The resulting mixture was subsequently heated to 80° C. over a period of 1 hour, and retained at this temperature for another 10 hours before cooling it down to room temperature. The product was washed repeatedly with water by centrifugation until the aqueous phase was clear, and resuspended in 0.5 liter of water. To this were then added 3.0 grams of cerium ammonium nitrate and 75 grams of a one percent aqueous solution of nitric acid, and the resulting mixture stirred overnight at 25° C. The product was washed repeatedly with water by centrifugation until the aqueous phase was clear, and then freeze dried utilizing a fluid bed dryer operated at ambient temperature to about 40° C. The toner obtained comprised about 94 percent of the above core resin, about 3.0 percent of the above pigment, about 0.01 to about 0.5 percent of the above cellulose coating, and about 2 percent of chelated cerium, evidenced a volume average particle diameter of 5.6 microns, and a particle size distribution of 1.33 according to Coulter Counter measurements. For the toner of this Example, the powder flow was evaluated to 4.5 percent cohesion as measured by the HOSOKAWA POWDER TESTER TM as described in Comparative Example I.

A charged developer was then prepared as described in Comparative Example I. The toner of this Example (II) displayed a triboelectric value of 8 microcoulombs per gram as determined in the known Faraday Cage apparatus. Also, latent images were formed in a xerographic experimental imaging device similar to the Xerox Corporation 9200, and excellent images were obtained with the aforementioned developer, such as excellent resolution characteristics with no background deposits.

EXAMPLE III

A 7 micron (volume average particle diameter) cyan in situ toner comprised of a styrene-acrylate core, HELIOGEN BLUE TM pigment, methylethyl cellulose coating, and oxidized and metal chelated with cerium ammonium nitrate was prepared as follows.

A mixture of 176 grams of styrene, 24 grams of n-butyl acrylate, and 7 grams of HELIOGEN BLUE TM pigment (obtained from BASF) was ball milled for 24 hours. To this mixture were added 3.0 grams each of 2,2'-azobis-(2,4-dimethylvaleronitrile) abd 2,2'-azobis-(isobutyronitrile), and the mixture was roll blended until all the aforementioned free radical initiators were dissolved. One hundred and fifty (150) grams of the resulting mixture were transferred to a 2-liter reaction vessel containing 700 milliliters of a 1.0 percent aqueous TYLOSE ® solution, and the resulting mixture was homogenized for 2 minutes using a Brinkmann polytron operating at 10,000 rpm. Thereafter, the mixture was mechanically stirred at room temperature for 30 minutes. The resulting mixture was subsequently heated to 80° C. over a period of 1 hour, and retained at this temperature for another 10 hours before cooling it down to room temperature. The product was washed repeatedly with water by centrifugation until the aqueous phase was clear, and resuspended in 0.5 liter of water. To this were then added 3.0 grams of cerium ammonium nitrate and 75 grams of a one percent aqueous solution of nitric acid, and the resulting mixture stirred overnight at 25° C. The product was washed repeatedly with water by centrifugation until the aqueous phase was clear, and then freeze dried utilizing a fluid bed dryer operated at ambient temperature to about 40° C. The in situ encapsulated toner, which comprised about 94 percent of the above core resin, about 3.0 percent of the above pigment, about 0.01 to about 0.5 percent of the above cellulose coating, and about 2 percent of chelated cerium, evidenced a volume average particle diameter of 5.6 microns, and a particle size distribution of 1.33 according to Coulter Counter measurements. For the toner of this Example, the powder flow was evaluated to 7.6 percent cohesion as measured by the HOSOKAWA POWDER TESTER ® as described in Comparative Example I. The powder flow of this toner was considered to be excellent.

A charged developer was then prepared as described in Comparative Example I. The toner of this Example displayed a triboelectric value of 11 microcoulombs per gram as determined in the known Faraday Cage apparatus. Also, latent images were formed in a xerographic experimental imaging device similar to the Xerox Corporation 9200, and excellent images were obtained with the aforementioned developer, such as excellent resolution characteristics with substantially no background deposits.

EXAMPLE IV

A 3 micron (volume average particle diameter) yellow in situ toner comprised of a styrene-acrylate core, HELIOGEN BLUE TM pigment, methylethyl cellulose coating, and oxidized and metal chelated with cerium ammonium nitrate was prepared as follows.

A mixture of 176 grams of styrene, 24 grams of n-butyl acrylate, and 7 grams of HELIOGEN BLUE TM pigment (obtained from BASF) was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. One hundred and fifty (150) grams of the resulting mixture were transferred to a 2 liter reaction vessel containing 700 milliliters of a 1.0 percent aqueous TYLOSE ® solution, and the resulting mixture was homogenized for 2 minutes using a Brinkmann polytron operating at 10,000 rpm. Thereafter, the mixture was mechanically stirred at room temperature for 30 minutes. The resulting mixture was subsequently heated to 80° C. over a period of 1 hour, and retained at this temperature for another 10 hours before cooling it down to room temperature. The product was washed repeatedly with water by centrifugation until the aqueous phase was clear, and resuspended (the toner product) in 0.5 liter of water. To this was then added 3.0 grams of cerium ammonium nitrate and 75 grams of a one percent aqueous solution of nitric acid, and the resulted mixture stirred overnight at 25° C. The product was washed repeatedly with water by centrifugation until the aqueous phase was clear, and then freeze dried utilizing a fluid bed dryer operated at ambient temperature to about 40° C. The in situ toner product, which comprised about 94 percent of the above core resin, about 3.0 percent of the above pigment, about 0.01 to about 0.5 percent of the above cellulose coating, and about 2 percent of chelated cerium, evidenced a volume average particle diameter of 5.6 microns, and a particle size distribution of 1.33 according to Coulter Counter measurements. For the toner of this example, the powder flow was evaluated to 6 percent cohesion as measured by the HOSOKAWA POWDER TESTER ® as described in Comparative Example I. The powder flow of this toner was thus considered to be excellent.

A charged developer was then prepared as described in Comparative Example I. The toner of this Example displayed a triboelectric value of 6 microcoulombs per gram as determined in the known Faraday Cage apparatus. Also, latent images were formed in a xerographic experimental imaging device similar to the Xerox Corporation 9200, and excellent images were obtained with the aforementioned developer, such as excellent resolution characteristics.

EXAMPLE V

A 3 micron (volume average particle diameter) magenta in situ toner comprised of a styrene-acrylate core, HELIOGEN BLUE TM pigment, methylethyl cellulose coating, 0.1 micron in thickness, and oxidized and metal chelated with cerium ammonium nitrate was prepared as follows.

A mixture of 176 grams of styrene, 24 grams of n-butyl acrylate, and 7 grams of HELIOGEN BLUE TM pigment (obtained from BASF) was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. One hundred and fifty (150) grams of the resulting mixture were transferred to a 2 liter reaction vessel containing 700 milliliters of a 1.0 percent aqueous TYLOSE ® solution containing a 0.04 percent by volume of sodium dodecylsulfate, and the resulting mixture was homogenized for 2 minutes using a Brinkmann polytron operating at 10,000 rpm. Thereafter, the mixture was mechanically stirred at room temperature for 30 minutes. The resulting mixture was subsequently heated to 80° C. over a period of 1 hour, and retained at this temperature for another 10 hours before cooling it down to room temperature. The product was washed repeatedly with water by centrifugation until the aqueous phase was clear, and resuspended in 0.5 liter of water. To this was then added 3.0 grams of cerium ammonium nitrate and 75 grams of a one percent aqueous solution of nitric acid, and the resulting mixture stirred overnight at 25° C. The toner product was washed repeatedly with water by centrifugation until the aqueous phase was clear, and then freeze dried utilizing a fluid bed dryer operated at ambient temperature to about 40° C. The in situ toner product, which was comprised of about 94 percent of the above core resin, about 3.0 percent of the above pigment, about 0.01 to about 0.5 percent of the above cellulose coating, and about 2 percent of chelated cerium, evidenced a volume average particle diameter of 5.6 microns, and a particle size distribution of 1.33 according to Coulter Counter measurements. For the toner of this Example, the powder flow was evaluated to 5.2 percent cohesion as measured by the HOSOKAWA POWDER TESTER ® as described in Comparative Example I. The powder flow of this toner is thus considered to be excellent.

A charged developer was then prepared as described in Comparative Example I. The toner of this Example displayed a triboelectric value of 15 microcoulombs per gram as determined in the known Faraday Cage apparatus. Also, latent images were formed in a xerographic experimental imaging device similar to the Xerox Corporation 9200, and excellent images were obtained with the aforementioned developer, such as excellent resolution characteristics and substantially no background deposits.

EXAMPLE VI

A 7 micron (volume average particle diameter) cyan in situ toner comprised of a styrene acrylate core, HELIOGEN BLUE TM pigment, methylethyl cellulose coating, oxidized and metal chelated with cerium ammonium nitrate, and surface coated with a poly(trifluoroethylmethacrylate) resin by emulsion coalescence was prepared as follows.

A mixture of 176 grams of styrene, 24 grams of n-butyl crylate, and 7 grams of HELIOGEN BLUE TM pigment (obtained from BASF) was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. One hundred and fifty (150) grams of the resulting mixture were transferred to a 2-liter reaction vessel containing 700 milliliters of a 1.0 percent aqueous TYLOSE ® solution, and the resulting mixture was homogenized for 2 minutes using a Brinkmann polytron operating at 10,000 rpm. Thereafter, the mixture was mechanically stirred at room temperature for 30 minutes. The resulting mixture was subsequently heated to 80° C. over a period of 1 hour, and retained at this temperature for another 10 hours before cooling it down to room temperature. The product was washed repeatedly with water by centrifugation until the aqueous phase was clear, and resuspended in 0.5 liter of water. To this was then added 3.0 grams of cerium ammonium nitrate and 75 grams of a one percent aqueous solution of nitric acid, and the resulting mixture stirred overnight at 25° C. The toner product was washed repeatedly with water by centrifugation until the aqueous phase was clear, resuspended in 0.5 liter of water and treated with 5 grams of trifluoro ethyl methacrylate, 0.65 gram of potassium persulfate and 0.24 gram of sodium bisulfite. The mixture was then stirred at 25° C. for two hours, washed repeatedly with water by centrifugation until the aqueous phase was clear and then freeze dried utilizing a fluid bed dryer operated at ambient temperature to about 40° C. The in situ toner product, which was comprised of about 92 percent of the above core resin, about 3.0 percent of the above pigment, about 0.01 to about 0.5 percent of the above cellulose coating, about 2 percent of chelated cerium, and about 3 percent of the above fluorinated resin, evidenced a volume average particle diameter of 5.6 microns, and a particle size distribution of 1.33 according to Coulter Counter measurements. For the toner of this Example, the powder flow was evaluated to 6.6 percent cohesion as measured by the HOSOKAWA POWDER TESTER ® as described in Comparative Example I. The powder flow of this toner was thus considered to be excellent.

A negative charged developer was then prepared as described in Comparative Example I. The toner of this Example displayed a triboelectric value of −45 microcoulombs per gram as determined in the known Faraday Cage apparatus. Also, latent images were formed in a xerographic experimental imaging device similar to the Xerox Corporation 9200, and excellent images were obtained with the aforementioned developer, such as excellent resolution characteristics.

EXAMPLE VII

A 3 micron (volume average particle diameter) yellow in situ toner comprised of a styrene-acrylate core, HELIOGEN BLUE TM pigment, methylethyl cellulose coating, oxidized and metal chelated with cerium ammonium nitrate, and surface coated with the poly(trifluoroethylmethacrylate) resin by coalescence was prepared as follows.

A mixture of 176 grams of styrene, 24 grams of n-butyl acrylate, and 7 grams of HELIOGEN BLUE TM pigment (obtained from BASF) was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. One hundred and fifty (150) grams of the resulting mixture were transferred to a 2-liter reaction vessel containing 700 milliliters of a 1.0 percent aqueous TYLOSE ® solution, and the resulting mixture was homogenized for 2 minutes using a Brinkmann polytron operating at 10,000 rpm. Thereafter, the mixture was mechanically stirred at room temperature for 30 minutes. The resulting mixture was subsequently heated to 80° C. over a period of 1 hour, and retained at this temperature for another 10 hours before cooling it down to room temperature. The product was washed repeatedly with water by centrifugation until the aqueous phase was clear, and resuspended in 0.5 liter of water. To this were then added 3.0 grams of cerium ammonium nitrate and 75 grams of a one percent aqueous solution of nitric acid, and the resulting mixture stirred overnight at 25° C. The product was washed repeatedly with water by centrifugation until the aqueous phase was clear, resuspended in 0.5 liter of water and treated with 5 grams of trifluoroethylmethacrylate, 0.65 gram of potassium persulfate and 0.24 gram of sodium bisulfite. The mixture was then stirred at 25° C. for two hours, washed repeatedly with water by centrifugation until the aqueous phase was clear and then freeze dried utilizing a fluid bed dryer operated at ambient temperature to about 40° C. The in situ toner product evidenced a volume average particle diameter of 5.6 microns, and a particle size distribution of 1.33 according to Coulter Counter measurements. For the toner, which was comprised of about 92 percent of the above styrene acrylate core resin, about 3.0 percent of the above pigment, about 0.01 to about 0.5 percent of the above cellulose coating, about 2 percent of chelated cerium, and about 3 percent of the above fluorinated resin of this Example, the powder flow was evaluated to 11 percent cohesion as measured by the HOSOKAWA POWDER TESTER ® as described in Comparative Example I.

A negative charged developer was then prepared as described in Example VI. The toner of this Example displayed a triboelectric value of −40 microcoulombs per gram as determined in the known Faraday Cage apparatus. Also, latent images were formed in a xerographic experimental imaging device similar to the Xerox Corporation 9200, and excellent images were obtained with the aforementioned developer, such as excellent resolution characteristics with substantially no background deposits.

EXAMPLE VIII

A 3 micron (volume average particle diameter) magenta in situ toner comprised of a styrene-acrylate core, HELIOGEN BLUE TM pigment, methylethyl cellulose coating, oxidized and metal chelated with cerium ammonium nitrate, and surface coated with a poly(trifluoroethylmethacrylate) resin by emulsion coalescence was prepared as follows.

A mixture of 176 grams of styrene, 24 grams of n-butyl acrylate, and 7 grams of HELIOGEN BLUE TM pigment (obtained from BASF) was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. One hundred and fifty (150) grams of the resulting mixture were transferred to a 2 liter reaction vessel containing 700 milliliters of a 1.0 percent aqueous TYLOSE ® solution, and the resulting mixture was homogenized for 2 minutes using a Brinkmann polytron operating at 10,000 rpm. Thereafter, the mixture was mechanically stirred at room temperature for 30 minutes. The resulting mixture was subsequently heated to 80° C. over a period of 1 hour, and retained at this temperature for another 10 hours before cooling it down to room temperature. The product was washed repeatedly with water by centrifugation until the aqueous phase was clear, and resuspended in 0.5 liter of water. To this was then added 3.0 grams of cerium ammonium nitrate and 75 grams of a one percent aqueous solution of nitric acid, and the resulting mixture stirred overnight at 25° C. The product was washed repeatedly with water by centrifugation until the aqueous phase was clear, resuspended in 0.5 liter of water and treated with 5 grams of trifluoroethylmethacrylate, 0.65 gram of potassium persulfate and 0.24 gram of sodium bisulfite. The mixture was then stirred at 25° C. for two hours, washed repeatedly with water by centrifugation until the aqueous phase was clear and then freeze dried utilizing a fluid bed dryer operated at ambient temperature to about 40° C. The in situ toner product, which was comprised of about 92 percent of the above core resin, about 3.0 of the above percent pigment, about 0.01 to about 0.5 percent of the above cellulose coating, about 2 percent of chelated cerium, and about 3 percent of the above fluorinated resin, evidenced a volume average particle diameter of 5.6 microns, and a particle size distribution of 1.33 according to Coulter Counter measurements. For the toner of this Example, the powder flow was evaluated to 6.2 percent cohesion as measured by the HOSOKAWA POWDER TESTER ® as described in Comparative Example I. The powder flow of this toner was considered to be excellent.

A negative charged developer was then prepared as described in Comparative Example I. The toner of this Example displayed a triboelectric value of -35 microcoulombs per gram as determined in the known Faraday Cage apparatus. Also, latent images were formed in a xerographic experimental imaging device similar to the Xerox Corporation 9200, and excellent images were obtained with the aforementioned developer, such as excellent line resolution characteristics.

EXAMPLE IX

A 7 micron (volume average particle diameter) cyan in situ toner comprised of a styrene-acrylate core, HELIOGEN BLUE TM pigment, methylethyl cellulose coating, oxidized and metal chelated with cerium ammonium nitrate, and surface coated with the copoly(-trifluoroethylmethacrylate)-copoly(methylmethacrylate) resin by emulsion coalescence was prepared as follows.

A mixture of 176 grams of styrene, 24 grams of n-butyl acrylate, and 7 grams of HELIOGEN BLUE TM pigment (obtained from BASF) was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. One hundred and fifty (150) grams of the resulting mixture were transferred to a 2 liter reaction vessel containing 700 milliliters of a 1.0 percent aqueous TYLOSE ® solution, and the resulting mixture was homogenized for 2 minutes using a Brinkmann polytron operating at 10,000 rpm. Thereafter, the mixture was mechanically stirred at room temperature for 30 minutes. The resulting mixture was subsequently heated to 80° C. over a period of 1 hour, and retained at this temperature for another 10 hours before cooling it down to room temperature. The product was washed repeatedly with water by centrifugation until the aqueous phase was clear, and resuspended in 0.5 liter of water. To this were then added 3.0 grams of cerium ammonium nitrate and 75 grams of a one percent aqueous solution of nitric acid, and the resulting mixture stirred overnight at 25° C. The product was washed repeatedly with water by centrifugation until the aqueous phase was clear, resuspended in 0.5 liter of water and treated with 2.5 grams of trifluoro ethyl methacrylate, 2.5 grams of methyl methacrylate, 0.65 gram of potassium persulfate and 0.24 gram of sodium bisulfite. The mixture was then stirred at 25° C. for two hours, washed repeatedly with water by centrifugation until the aqueous phase was clear and then freeze dried utilizing a fluid bed dryer operated at ambient temperature to about 40° C. The in situ toner product, which was comprised of about 92 percent of the above core resin, about 3.0 percent of the above pigment, about 0.01 to about 0.5 percent of the above cellulose coating, about 2 percent chelated cerium, and about 3 percent of the above fluorinated polymer, evidenced a volume average particle diameter of 5.6 microns, and a particle size distribution of 1.33 according to Coulter Counter measurements. For the toner of this Example, the powder flow was evaluated to 3.1 percent cohesion as measured by the HOSOKAWA POWDER TESTER TM as described in Comparative Example I.

A negative charged developed was then prepared as described in Example VI. The toner of this Example displayed a triboelectric value of −20 microcoulombs per gram as determined in the known Faraday Cage apparatus. Also, latent images were formed in a xerographic experimental imaging device similar to the Xerox Corporation 9200, and excellent images were obtained with the aforementioned developer, such as excellent line resolution characteristics.

Other modifications of the present invention may occur to those skilled in the art based upon a reading of the present disclosure and these modifications are intended to be included within the scope of the present invention.

What is claimed is:

1. A process for the preparation of toner compositions with alkyl cellulose on the surface which comprises the oxidation and metal chelation of the surface thereof with a metal oxidizing reagent.

2. A process for the preparation of toners which comprises the oxidation and metal chelation of the surface thereof, and subsequently coalescence by the absorption or sticking thereto of a fluoro containing polymer.

3. A process in accordance with claim 1 wherein the oxidation and metal chelation is accomplished with cerium ammonium nitrate, chromic acid, or potassium permanganate.

4. A process in accordance with claim 1 wherein the toner is comprised of a core comprised of a polymer and pigment encapsulated in a polymer shell.

5. A process in accordance with claim 1 wherein the toner is comprised of a core comprised of a polymer resin or resins, color pigment, dye, or mixtures thereof, and a coating thereover comprised of an alkyl cellulose.

6. A process in accordance with claim 5 wherein the alkyl cellulose is hydroxyethylmethyl cellulose, hydroxypropyl cellulose, or methyl cellulose.

7. A process in accordance with claim 5 wherein the polymer resin is an acrylate polymer, a methacrylate polymer, or a styrene polymer.

8. A process in accordance with claim 5 wherein the polymer resin is selected from the group consisting of acrylate copolymers, methacrylate copolymers, styrene, and styrene copolymers.

9. A process in accordance with claim 5 wherein the pigment is carbon black, magnetite, or mixtures thereof; or cyan, yellow, magenta, red, green, blue, brown, or mixtures thereof.

10. A process in accordance with claim 2 wherein the fluoropolymer is poly(trifluoroethylmethacrylate), or copoly(trifluoroethylmethacrylate)-copoly(methylmethacrylate)acrylate.

11. A process in accordance with claim 4 wherein the toner is prepared by dispersing a mixture of addition monomers, an optional preformed polymer resin, a free radical initiator, and a colorant comprised of a color pigment, dye or mixtures thereof to form a stable microdroplet suspension in an aqueous medium containing a cellulose polymer, and an optional inorganic surfactant; initiating the core resin-forming free radical polymerization by heating; oxidizing and chelating the surface thereof with a metallic reagent; and absorbing a fluoro containing emulsion resin thereon.

12. A process in accordance with claim 11 wherein the dispersion is accomplished at a temperature of from about 25° C. to about 35° C.

13. A process in accordance with claim 11 wherein the free radical polymerization is accomplished at a temperature of from about 35° C. to about 120° C.

14. A process in accordance with claim 11 wherein the metallic reagent is selected from the group comprising of cerium ammonium nitrate, chromium oxides, potassium permanganate, chromium perchlorate, chromium nitrate, sodium dichromate, ammonium dichromate, potassium dichromate, aluminum nitrate, boronic acid, barium perchlorate, calcium perchlorate, cobalt perchlorate, copper perchlorate, copper nitrate, dysprosium nitrate, iron nitrate, iron perchlorate, indium perchlorate, indium nitrate, ammonium hexachloroiridium, potassium hexanitroiridium, sodium hexanitroiridium, potassium pentabromonitroiridium, potassium chromate, sodium chromate, potassium hydroxytetranitronitrosylruthenium, manganese nitrate, sodium metaborate, hydrogen metaborate, sodium tetraborate, sodium hexanitroiridium, sodium hexanitroiron, nickel perchlorate, lead chromate, lead nitrate, and mixtures thereof.

15. A process in accordance with claim 11 wherein the fluoro containing resin is obtained from the emulsion polymerization of free radical monomers selected from the group consisting of fluoroalkylacrylate and fluoroalkylmethacrylates.

16. A process in accordance with claim 11 wherein the fluoropolymer is selected from the group consisting of trifluoromethylmethacrylate, trifluoroethylmethacrylate, trifluoropropylmethacrylate, trifluoromethylacrylate, trifluoroethylacrylate, fluoromethylmethacrylate, fluoroethylmethacrylate, fluoropropylmethacrylate, fluoromethylacrylate, fluoroethylacrylatemethylacrylate, difluoromethylmethacrylate, difluoroethylmethacrylate, difluoropropylmethacrylate, difluoromethylacrylate, difluoroethylacrylate, fluorostyrene, difluorostyrene, trifluorostyrene, tetrafluorostyrene, pentafluorostyrene, and mixtures thereof.

17. A process in accordance with claim 2 wherein the fluoro polymer is selected from the group comprising of poly-(fluoromethylacrylate), poly-(fluoroethylacrylate), poly-(fluoropropylacrylate), poly-(difluoromethylacrylate), poly-(difluoroethylacrylate), poly(-difoluoropropylacrylate), poly-(trfluoromethylacrylate), poly-(trifluoroethylacrylate), poly-(trifluoropropylacrylate), poly-(fluoromethylmethacrylate), poly-(fluoroethylmethacrylate), poly-(fluoropropylmethacrylate), poly-(difluoromethylmethacrylate), poly-(difluoroethylmethacrylate), poly-(difluoropropylmethacrylate), poly-(trfluoromethylmethacrylate), poly-(trifluoroethylmethacrylate), poly-(trifluoropropylmethacrylate), copoly-(triflouroethylmethacrylate)-copoly-(methylmethacrylate), copoly-(triflouropropylmethacrylate)-copoly-(methylmethacrylate), copoly-(triflouroethylmethacrylate)-copoly-(ethylmethacrylate), copoly-(triflouroethylmethacrylate)-copoly-(styrene), copoly-(triflouropropylacrylate)-copoly-(methylmethacrylate), and mixtures thereof.

18. A process in accordance with claim 11 wherein the oxidation and metal chelation is accomplished at a temperature of from about 20° C. to about 80° C., and the fluoropolymer emulsion coalescence is accomplished at a temperature of from about 25° C. to about 95° C.

19. A process in accordance with claim 1 wherein the powder flow is from about 1 percent cohesion to about 20 percent cohesion.

20. A process in accordance with claim 1 wherein the powder flow is from about 3 percent cohesion to about 10 percent cohesion, and toner passivation is obtained.

21. A process in accordance with claim 11 wherein the metallic reagent is selected in an amount of from about 0.5 percent to about 10 percent by weight of the toner, and the fluoropolymer is selected in an amount of from about 0.5 percent to about 10 percent by weight of the toner.

* * * * *

UNITED STATES PATENT AND TRADEMARK OFFICE

CERTIFICATE OF CORRECTION

PATENT NO. : 5,213,938

DATED : May 25, 1993

INVENTOR(S) : Guerino S. Sacripante, et al

It is certified that error appears in the above-indentified patent and that said Letters Patent is hereby corrected as shown below:

Example III, col. 14, line 36, delete "7" and insert --5.6--.

Example IV, col. 15, line 24, delete "3" and insert --5.6--.

Example IV, col. 15, line 24, delete "yellow" and insert --cyan--.

Example V, col. 16, line 12, delete "3" and insert --5.6--.

Example V, col. 16, lines 12 and 13, delete "magenta" and insert --cyan--.

Example VI, col. 17, line 3, delete "7" and insert --5.6--.

UNITED STATES PATENT AND TRADEMARK OFFICE

CERTIFICATE OF CORRECTION

PATENT NO. : 5,213,938

DATED : May 25, 1993

INVENTOR(S) : Guerino G. Sacripante, et al

It is certified that error appears in the above-indentified patent and that said Letters Patent is hereby corrected as shown below:

Example VII, col. 17, line 3, delete "yellow" and insert --cyan--.

Example VII, col. 17, line 67, delete "3" and insert --5.6--.

Example VIII, col. 18, line 64, delete "magenta" and insert --cyan--.

Example VIII, col. 18, line 64, delete "3" and insert --5.6--.

Example IX, col. 19, line 61, delete "7" and insert --5.6--.

Signed and Sealed this

Twelfth Day of April, 1994

Bruce Lehman

*Attest:*

BRUCE LEHMAN

*Commissioner of Patents and Trademarks*

*Attesting Officer*